US005201513A

United States Patent [19]

Mion

[11] Patent Number: 5,201,513

[45] Date of Patent: Apr. 13, 1993

[54] DEVICE FOR CONVEYING AND PILING SHEETS INTO STACKS

[75] Inventor: Jean-Luc Mion, La Tour du Pin, France

[73] Assignee: SA Martin, France

[21] Appl. No.: 840,128

[22] Filed: Feb. 24, 1992

[30] Foreign Application Priority Data

Feb. 26, 1991 [FR] France ..... 91 02522

[51] Int. Cl.[5] ..... B65H 29/44; B65H 29/32

[52] U.S. Cl. ..... 271/180; 271/197

[58] Field of Search ..... 271/300, 303, 177, 180, 271/197; 414/793.1

[56] References Cited

U.S. PATENT DOCUMENTS

| | | | |
|---|---|---|---|
| 2,987,314 | 6/1961 | Monaghan . | |
| 3,305,233 | 2/1967 | Cody | 271/180 |
| 3,406,966 | 10/1968 | Walton | 271/180 X |
| 3,490,764 | 1/1970 | Müller et al. . | |
| 3,820,779 | 6/1974 | Bishop . | |
| 4,905,843 | 3/1990 | Holbert | 271/197 X |

FOREIGN PATENT DOCUMENTS

| | | |
|---|---|---|
| 0173959 | 3/1986 | European Pat. Off. . |
| 1115566 | 10/1961 | Fed. Rep. of Germany . |
| 467207 | 2/1969 | Switzerland . |

*Primary Examiner*—Robert P. Olszewski
*Assistant Examiner*—Boris Milef
*Attorney, Agent, or Firm*—Hill, Steadman & Simpson

[57] ABSTRACT

A device for conveying and piling flat workpieces includes a conveyor comprising side-by-side endless belts with a vacuum chamber for each belt, which vacuum chambers are interconnected to a common source of vacuum and which chambers are separated by ducts which are in communication with either atmospheric air or pressurized air and contain ejector levers acting on an elongated flexible element to eject a sheet from the belts and to break the suction from the vacuum chambers on the sheet by uncovering openings in the ducts to supply air at atmospheric pressure or pressurized air to each of the vacuum chambers. The conveyor places the sheet in a piling store, which can then be removed as a batch of a certain number of sheets.

9 Claims, 10 Drawing Sheets

DEVICE FOR CONVEYING AND PILING SHEETS INTO STACKS

BACKGROUND OF THE INVENTION

The present invention is directed to a device for conveying and piling flat workpieces, especially die-cut blanks, plates or open paperboard boxes. The apparatus includes a conveyor with endless belts acting stepwise and jointly with a vacuum chamber and ejector, which is destined to remove the flat workpieces from the endless belts of the conveyor with a view of piling them up in a specific pile or store.

As a rule in known devices of the prior art, flat workpieces, such as, for instance, plates or sheets of corrugated board originating from a machine processing them, are pile up in one or several stores. From the stores, they are removed for either storage or ultimate transportation toward another destination, for instance toward another machine in charge of accomplishing an additional operation on the sheets of corrugated board.

In practice, a known device for conveying and piling flat workpieces, such as die-cut blanks, plates or open paperboard boxes, comprises a conveyor with endless belts, which are arranged to extend side-by-side and which have an upper surface of the lower drive run of each belt in contact with supports, which are arranged in such a way as to leave between them an adequate space communicating with a vacuum device containing an ejector equipped with a valve which acts on the support of the endless belts, in such a way as to close the free space left between the supports. The ejector is raised and lowered during a dwell in the movement of the belts to cause an ejection of the sheet of corrugated board from the belts into a pile.

U.S. Pat. No. 3,820,779, whose disclosure is incorporated herein by reference thereto, is directed to a device for carrying sheets of corrugated board by means of a conveyor equipped with several conveyor belts appropriately spaced side-by-side in the crosswise direction. These conveyor belts are carried forward stepwise by an appliance having the shape of a Geneva wheel that looks like a Maltese cross, which wheel coacts with a pin on a rotating lever to cause intermittent movement with a slow-down or deceleration followed by a standstill for each of the conveyor belts during each plate advance cycle. Moreover, it is foreseen to fit on top of the conveyor belts, a vacuum device designed to aspire or to provide a suction to the sheets of corrugated board to draw the sheet against the conveyor belts, and this aspiration is achieved through the space left open between the belts. Furthermore, a lower part or surface of the vacuum device provides a belt support, which is also appropriately spaced so that the space left free between the belts can be kept.

The device of this patent includes a plate ejector designed to remove plates from the belts so as to have them drop into one or several storage devices. These ejectors consist of two arms connected to one another on their lowest part by a strip designed to engage and contact an upper surface of each of the sheets of cardboard which are to be ejected.

The arms are arranged on both conveyor ends are controlled synchronously with the stepwise belt movement. In order to interrupt the aspiration caused by the vacuum device, the two arms are provided with a flap, which is arranged inside the vacuum device. When the aspiration resumes, the flap is removed from the upper side of the belt supports by stopping devices arranged on both arms of the ejectors. When a plate is ejected, the aspiration is interrupted by the gravity controlled flap, which is to close the upper part of the space between the various belt supports.

One of the disadvantages of the execution of this device is that during the ejection of the sheet of cardboard, there always remains a relative displacement between the ejector and the upper surface of the sheet of cardboard. This slight relative displacement is admissible and can be permitted when having rather low operating speeds. However, on presently built machines with very high production speeds reaching 10,000 sheets per hour, a relative displacement between the ejector and each sheet is not allowable. In fact, with these speeds, a relative displacement between the ejector and the plate will cause an irregular piling of the sheets in the storage device, which will cause an erratic subsequent operation on the batch thus made.

To overcome these drawbacks, it would be helpful, as with other devices, to provide a front stop or baffle, of which the leading edge of the sheet comes to standstill; however, this would then cause the plate front edge to knock against this stop. Such a provision of a stop can also cause damage to the front edge, which is not allowable.

Another drawback which is present with this device occurs with the problem of controlling the setting-in of the aspiration. In fact, as may be gathered from the above-mentioned U.S. patent, the aspiration effect will not be cut immediately with the running of the plate ejection so that the plate will remain stuck to the ejectors during a certain period. This sticking to the ejector will prolong the time needed for the sheet to drop into the pile store and possibly cause a collision when there are high production speeds. At any rate, a prolonged dropping time would impair the performance of the device.

In the device described above, the ejectors are controlled by means permanently connected to the means commanding the stepwise action of the conveyor belts. If it is desirable to use several successive piling stores, this construction is a handicap, since, in such a case, it is not possible to arrange two successive conveyor devices of this type. In fact, since the action of the ejector cannot be neutralized, a double-level plate conveyance system will be a required solution and includes a deflector enabling the plates to be directed to one or the other of the conveying and piling devices. Thus, an additional conveyor is necessary. Such a design would be expensive and, besides that, increases the risk of jeopardizing the piling action.

SUMMARY OF THE INVENTION

The present invention is directed to improving a conveying and piling device which overcomes the above-mentioned drawbacks and disadvantages, and which device can be used for processing solid or corrugated board.

According to one of the characteristics of the present invention, the device is to be used for conveying and piling flat workpieces. The device comprises a plurality of endless conveyor belts arranged to extend side-by-side, means for advancing the conveyor belt in a stepwise manner, a plurality of vacuum chambers arranged with one vacuum chamber for each belt and a lower surface of the vacuum chambers contacting an upper surface of a lower run of the respective conveyor belts, said adjacent vacuum chambers being separated from one another by a duct, each of the vacuum chambers being provided with aspiration holes situated in the vicinity of a side edge of the respective endless belt, and the vacuum chambers being interconnected to a common aspiration hood, ejectors being arranged within each of the ducts which separate two vacuum chambers, each ejector consisting of pivoting levers acting on a linear element mounted at one end of the device to a fixed point and having the other end connected to compensating means to enable expansion and contraction of the linear element, said linear element closing an aperture on the lower part of said duct, which aperture is arranged on the same surface as the lower surface of the vacuum chambers so that when the ejectors are in a retracted position, the linear device closes the duct, and when the ejectors are moved to an ejecting position, the linear device opens each of the ducts to allow air to break the suction applied to a blank or sheet by the vacuum chambers.

According to one of the characteristics of the invention, the lower surface of the vacuum chamber is actually a convex surface which is bowed with a radius of curvature which is determined by the deflection or sag of the lower run of each of the endless belts.

According to another characteristic of the invention, the ejecting levers are pivotably mounted and act on a linear element, which is a flexible tape, which is attached at one end to a first cross member of a frame of the device, which cross member is at an upstream or inlet end of the conveyor, and the other end is held by the compensating means, which consist of a cmmpression spring, which is secured on a second cross member situated at a downstream end near the discharge end of each conveyor.

According to other characteristics, the device for conveying and piling workpieces comprises ducts separating the chambers from one another and connected to the atmosphere or, depending on the execution preferred, to a compressed air source.

It would be useful to provide the device for conveying flat workpieces with ejectors consisting of pivoting levers, the stepwise drive system of which would be declutchable from the stepwise drive system of the conveyor's endless belts.

An advantage obtained with this invention essentially consists in the fact that the conveyance and piling of flat workpieces can be obtained at high speeds without there being any relative displacement between the ejectors ejecting the flat workpieces and the flat workpieces' upper surface during their removal from the conveyor belt and that there is a possibility with the help of two identical devices according to the invention to achieve a piling of flat workpieces in two successive stores by shifting the workpieces on a single plane corresponding to the plane defined by the lower surface of the lower drive runs of the conveyor belts. Consequently, the device used for conveying and piling flat workpieces distinguishes itself by a very high operational safety at high speeds by a very high piling accuracy and by the fact that the flat workpieces are carried and piled without any damage.

Other advantages and features of the invention will be readily apparent from the following description of the preferred embodiments, the drawings and claims.

DESCRIPTION OF THE PREFERRED EMBODIMENTS

Figure 1:
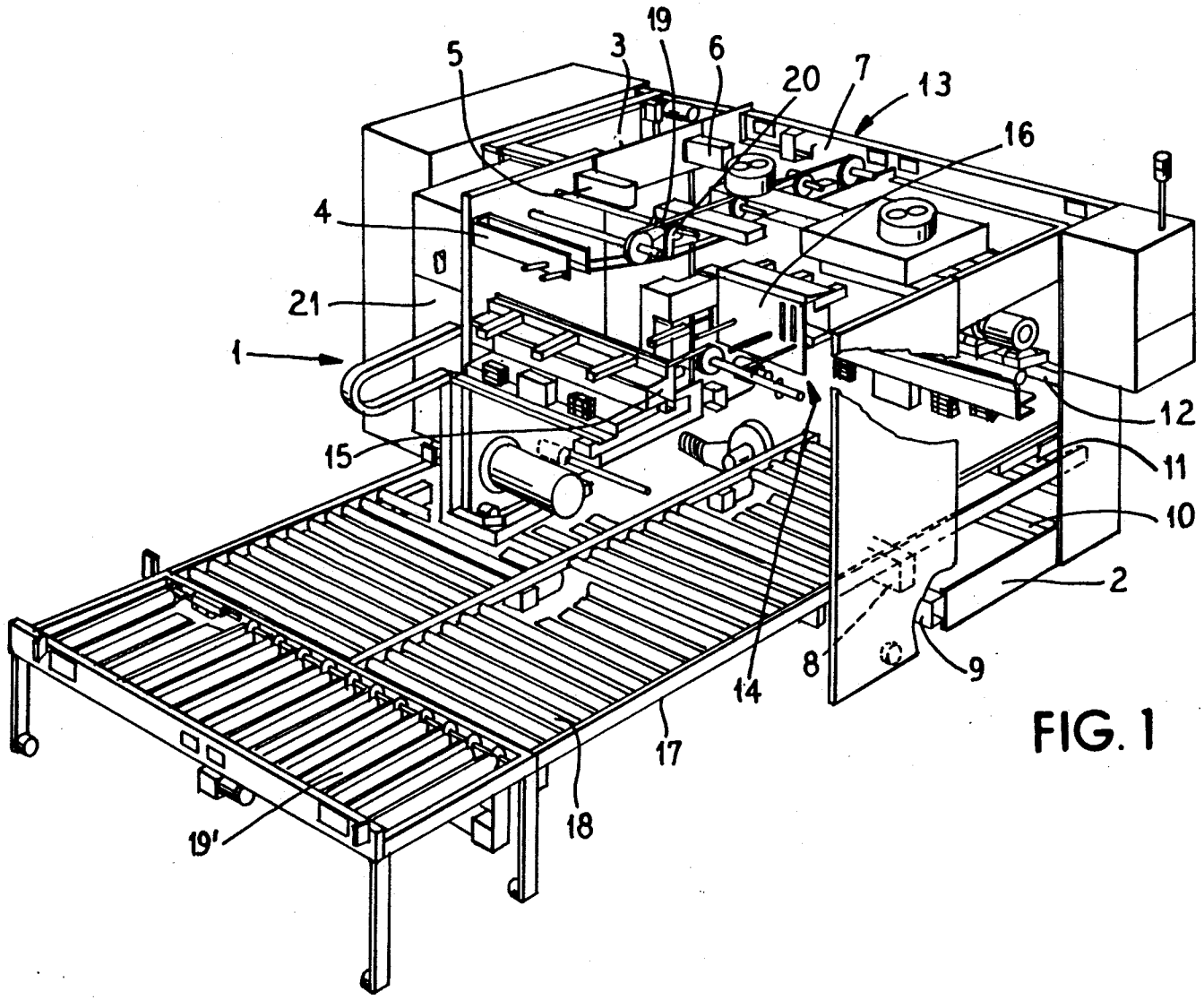
FIG. 1 is a perspective view with portions removed for purposes of illustration of a delivery station of a machine used for conveying corrugated board.

The principles of the present invention are particularly useful when incorporated in a delivery station, generally indicated at 1 in FIG. 1, for a machine converting corrugated board. The delivery station consists of two lateral frames 2 and 3, which are interconnected by cross members 4, 5, 6, 7, 8, 9, 10, 11, and 12. A conveyor, generally indicated at 13, which conveyor 13 includes endless belts 19 and various conveying elements situated with the belts extending side-by-side and only one being illustrated in drawing, is arranged between the two lateral frames 2 and 3 and is suspended on the cross members 5 and 6. A pile store 14 comprising a front wall 15 and a rear wall 16 is arranged underneath the conveyor 13. This piling store 14 is arranged above a batch removing device 17, which is supported by cross members 8 and 11 and includes two roller conveyors 18 and 19'. A drive system for the endless belts 19, as well as a drive system for the ejector, for instance ejecting levers 20, are arranged within the housing 21, which is attached against the outer side of the frame member 3.

Figure 2:
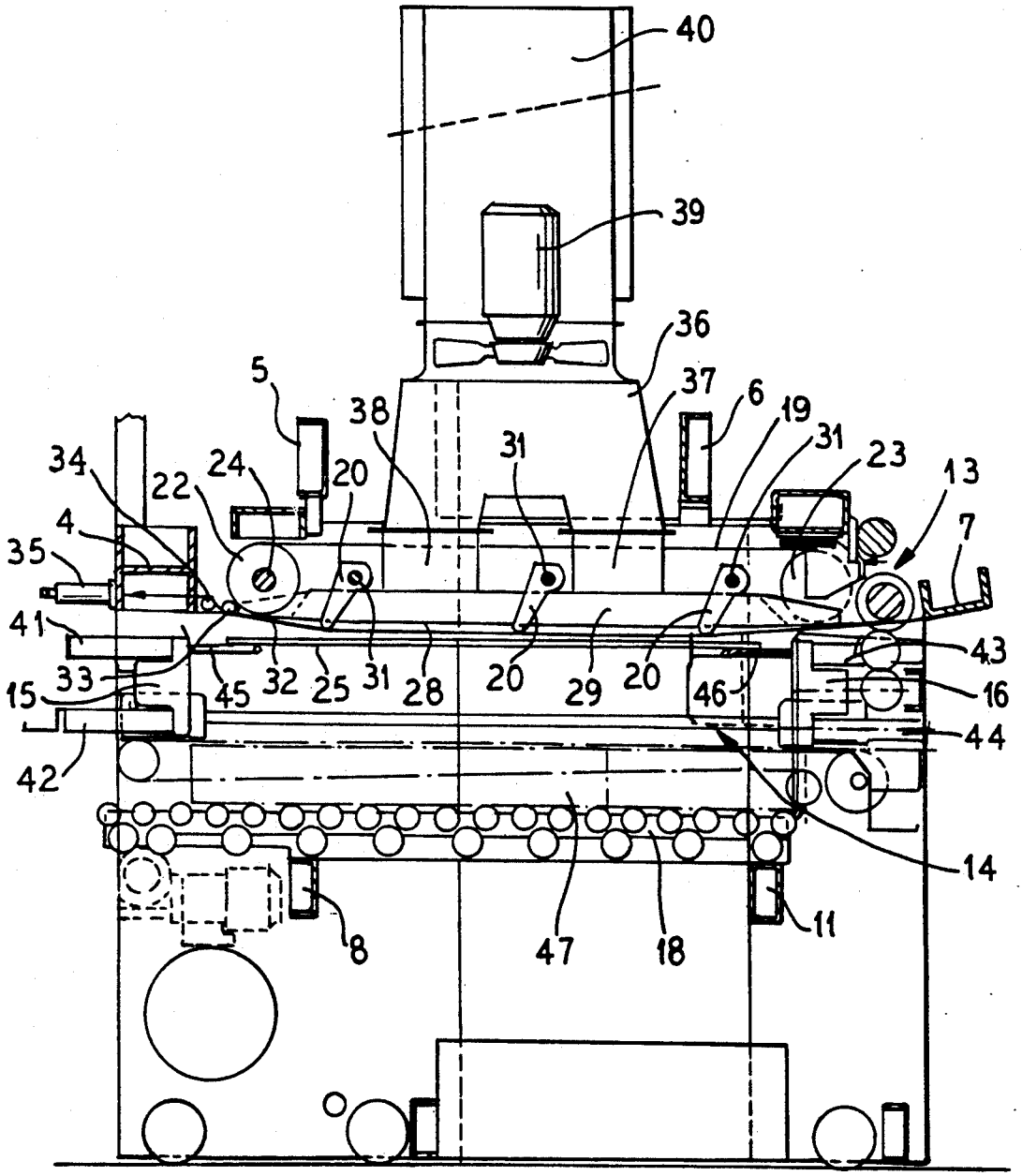
FIG. 2 is a schematic side view with portions removed for purposes of illustration of a piling and conveying device according to the present invention.

The conveying and piling device shown in FIG. 2 includes a conveying element or endless belt 19 which extends around a driven pulley 22 and another pulley 23. As illustrated, the pulley 23 is mounted near the entrance of the sheets into the conveying and piling device, whereas the driven pulley 22 is mounted on a control shaft 24 on a downward or downstream portion of the device. The shaft 24 is connected with a stepwise drive means 210, which is located in the housing 21 and schematically illustrated in FIG. 3, and the means 210 might be conceived as a conventional cam and lever drive system able to transmit an appropriate motion to the belts 19. This motion is chosen so that the belts 19 will be moved at a high speed during a first period of their advance and they are then decelerated to a full standstill, which will be as adequate as possible in order to provide an optimum stopping or dwell time, during which the carried cardboard sheet 25 will be removed from the endless belts 19 with a view to its subsequent piling in a stack or batch, such as 47.

Figure 3:
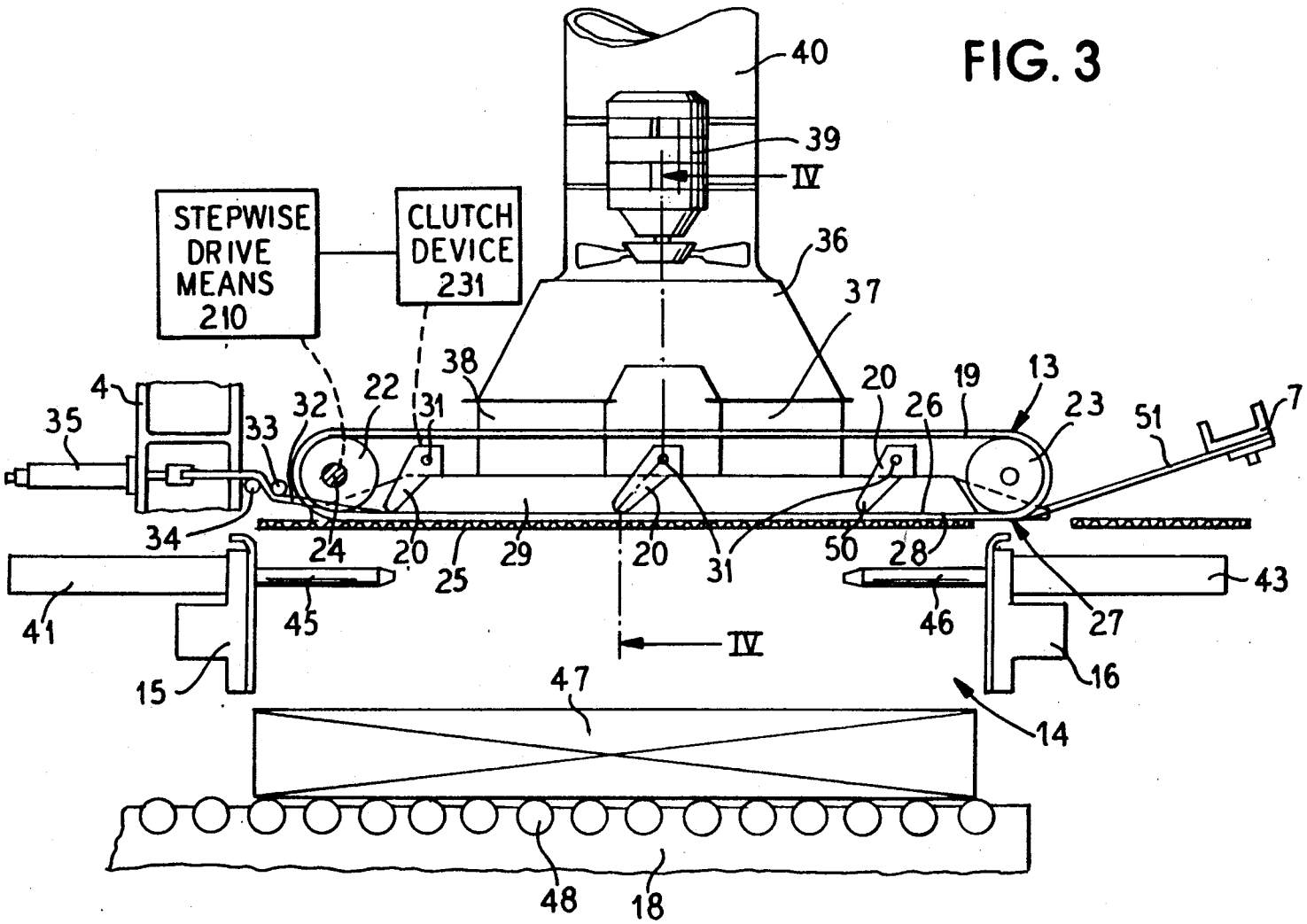
FIG. 3 is a schematic side view with portions removed for purposes of illustration of a simplified version of the conveying and piling device according to the present invention.

The belts 19, as best illustrated in FIG. 3, have a lower run 27 that extends between the two pulleys 22 and 23 and an upper surface 26 of this lower run 27 is in contact with a lower surface 28 of a vacuum chamber 29. Due to the arrangement of the belt and vacuum chamber, each corrugated board, such as the sheet 25, will be held on the belts when the sheet is being moved into the device.

Attention should be drawn to the fact that, as may be gathered from FIG. 2, the corrugated board or sheet 25 is represented in its ejecting phase, i.e., when the plate has been removed from the endless belts 19. The removal of the corrugated board 25 from the endless belts is achieved by means of ejecting levers 20, which are mounted on pivotable shafts 31. In order to allow temporary declutching, the pivoting shafts 31 are connected to the drive means 210 through a clutch device 231 (FIG. 3) so that the rotation of the shafts 31 is synchronized with the running or stopping of the endless belts 19. In this way, during the time when the movement of the endless belt 19 is stopped, the ejecting levers 20 are actuated in such a way that their action on a linear element, such as, for instance, a flexible tape 32 or a section of the belt, will cause the removal and dropping of the sheet 25 of the corrugated board into the piling store 14. The flexible tape 32 is attached at one end to the cross member 7, which is situated at the inlet side of the conveying element, whereas the other end is led around two idler rollers 33 and 34 and is attached to a compensating means 35, which is mounted on the cross member 4. The fixture of the flexible tape 32 will be explained in greater detail hereinafter with regard to FIG. 7.

Each vacuum chamber 29 is connected to an aspiration hood 36 by ducts 37 and 38. The aspiration hood 36 is provided with a fan or turbine 39 which is connected to an exhaust duct 40.

The piling store 14 located underneath the conveying element includes a front wall 15 carrying, in a crosswise arrangement, a certain number of upper and lower pneumatic jacks 41 and 42. The piling store 14 also includes a rear wall 16 carrying a certain number of upper and lower pneumatic jacks 43 and 44, which are aligned with the jacks 41 and 42, respectively. The number of jacks 41 on the front wall 15 are mounted opposite the jacks 43 on the rear wall 16, whereas the jacks 42 on the front wall 15 are fitted opposite the jacks 44 on the rear wall. Rods 45 and 46 of the jacks 41-44 are alternately moved to and from the sides of the front and rear walls 15 and 16, respectively, so as to temporarily make up an upper and a lower grid used for intercepting and holding the sheets 25 deposited from the belts.

When the required height of the batch 47 of sheets of corrugated board are formed on the lower grid, the upper grid consisting of the rods 45 and 46 of the jacks 41 and 43 are then advanced to the position illustrated in FIG. 2 to retain any sheets of corrugated board coming from the conveyor elements. This enables the withdrawal of the corresponding rods of the jacks 42 and 44 so that the batch 47 of sheets retained on the lower grid consisting of the rods of the lower jacks can drop onto the roller conveyor 18, which, in turn, will carry the batch 47 toward the outlet of the delivery station. After that stage, the rods of the lower jacks 42 and 44 are, again, advanced to the extended position to form the lower grid and the rods 45 and 46 of the upper jacks 41 and 43 will be withdrawn to cause the batch which accumulated on the upper grid to drop onto the lower grid.

The lower and upper grids might also consist in a kind of comb which is retractable into the front and rear walls by means of a mechanism with connecting rods and crankshafts.

A simplified version of the conveying and piling device in its aspirating phase, for instance, is illustrated in FIG. 3, wherein the endless belts 19 are stopped and the ejecting levers 20 begin to push the flexible tape 32 downward in order to remove a sheet 25 from the belts 19. With this version, the conveying elements used are actually the same as those described with reference to FIG. 2. In this version, the piling store 14, which would still have a front and rear wall 15 and 16, respectively, however, only has the jacks 41 and 43 having the rods 45 and 46 which form the upper grid. With this execution, the piling of the corrugated sheets 25 would take place immediately on the rollers 48 of the roller conveyor 18. With the batch 47 of sheets 25 having obtained the appropriate height, the rods 45 and 46 will then be advanced to the position illustrated in FIG. 3 to intercept any additional sheets 25 being deposited while the batch 47 is being removed on the roller conveyor 18. The rods 45 and 46 will then be withdrawn and the plate batch temporarily stacked on these rods will then drop again onto the rollers 48 of the roller conveyor 18.

Figure 4:
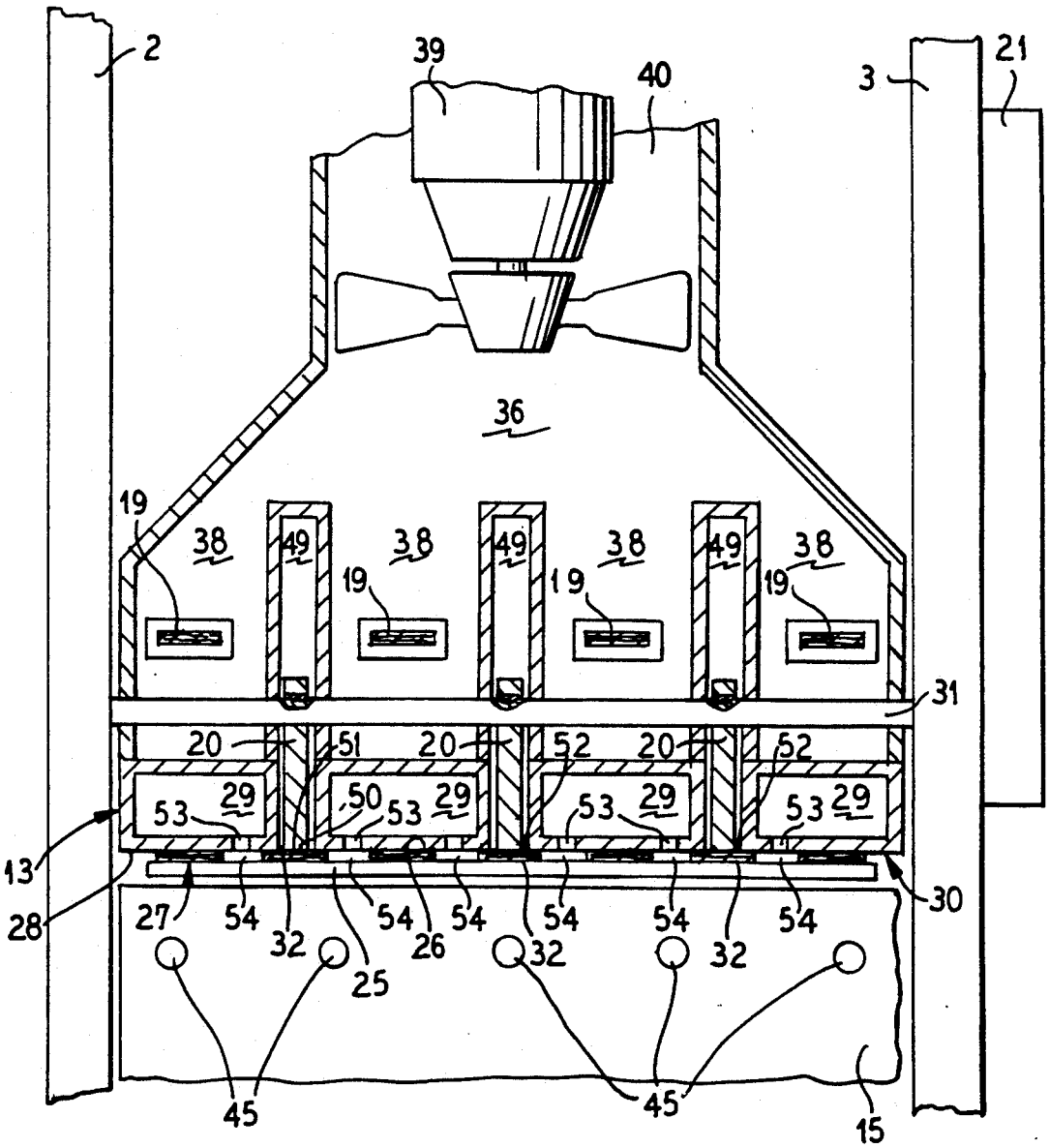
FIG. 4 is a cross sectional view taken along the lines IV—IV of FIG. 3, which illustrates the conveyor in the aspirating phase.

FIG. 4 shows the transverse spacing of the vacuum chambers 29 and the endless belts 19. In this Figure, only four vacuum chambers 29 are represented, although obviously in practice the number of vacuum chambers 29 may be increased, as might be required by the width of the conveyor 13.

A lower surface 28 of each vacuum chamber 29 is situated on the same plane 30 so that the upper surface 26 of the lower run 27 of each of the endless belts 19 is in contact with its respective vacuum chamber 29 when a corrugated plate or sheet 25 is seized by aspiration. The vacuum chambers 29 are separated from one another by a duct 49, which either communicates with the outer atmosphere or is connected to a compressed air source, as will be described hereinafter. Each duct 49 contains the ejecting lever 20, which is fitted with an end 50 in permanent contact with an upper surface 51 of the flexible tape 32. The lower part of the duct 49 has an aperture 52 which extends throughout each duct 49. During the aspiration phase, the ejecting levers 20 occupy a position so that the flexible tape 32 will close or shut the aperture 52, thus allowing the vacuum to be built-up through the aspiration holes 53 of the lower surface 28 of the vacuum chambers 29 in the immediate section 54 separating the lower runs 27 of the endless belts 19 and the flexible tapes 32. Every ejecting lever 20 is permanently fixed on a shaft 31 by means of a conventional fixture, for instance a cotter 55 (best illustrated in FIG. 10), and by locked screws.

Figure 5:
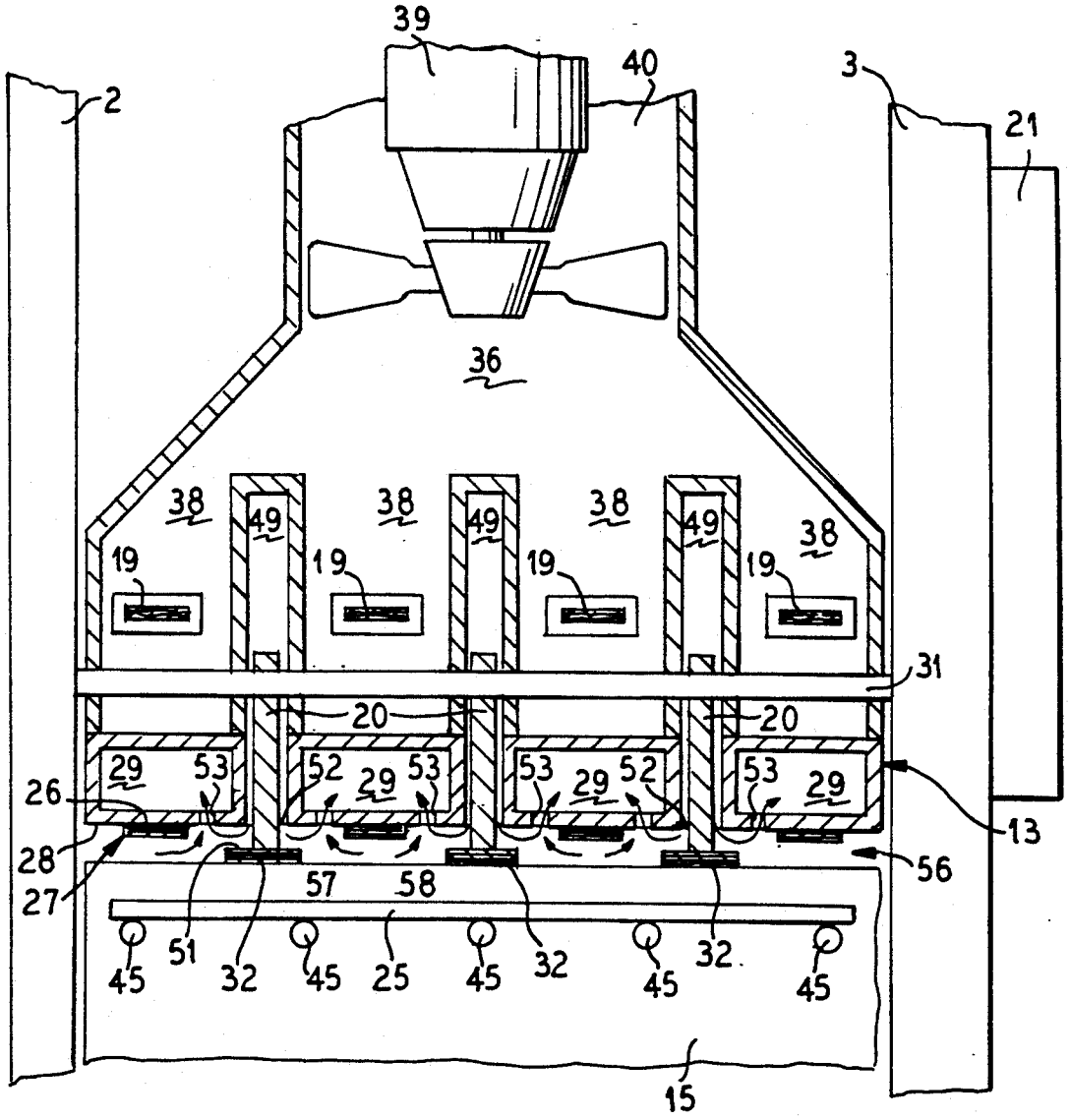
FIG. 5 is a cross sectional view similar to FIG. 4 showing the conveyors in the ejecting phase.
Figure 8:
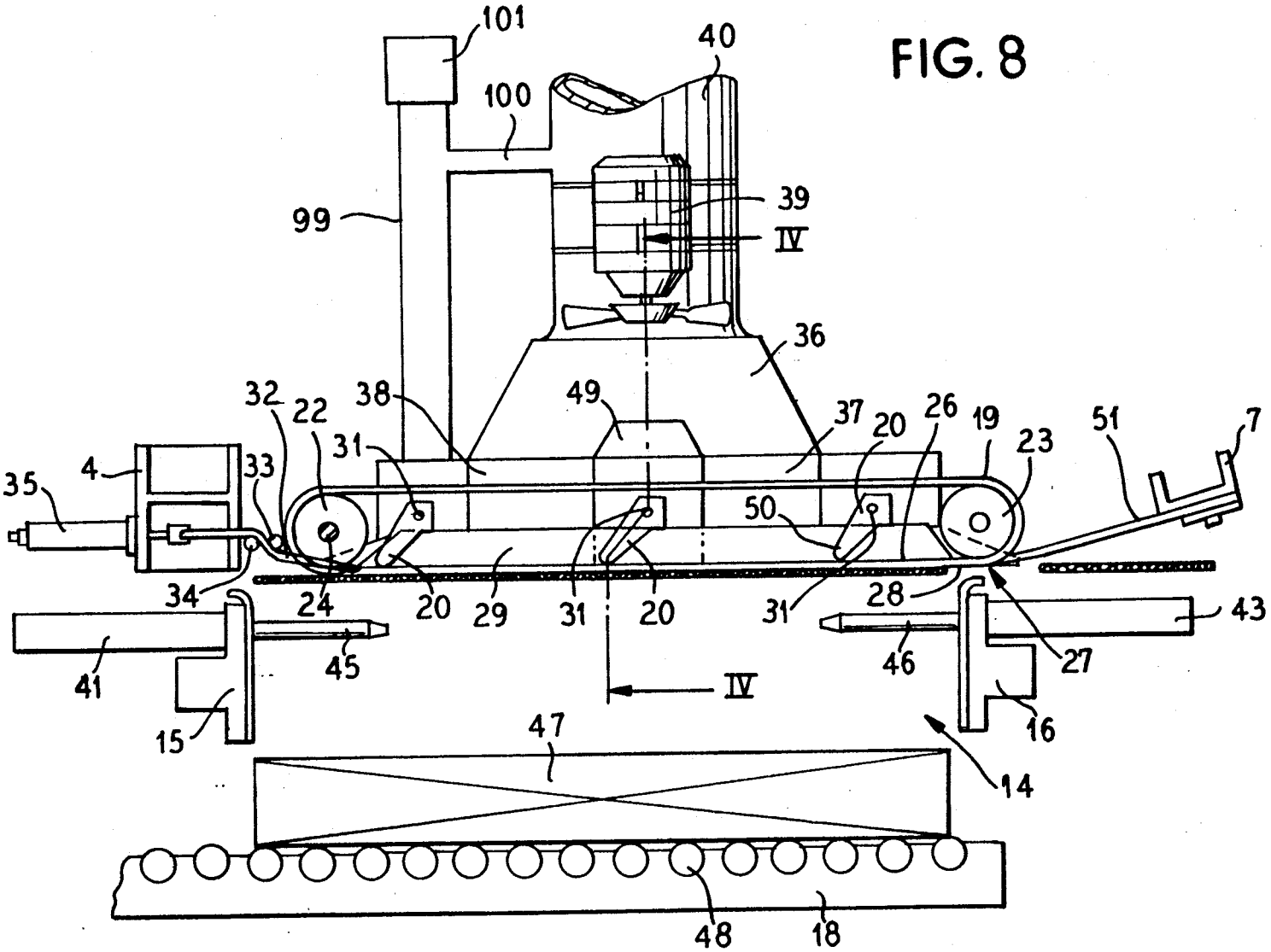
FIG. 8 is a schematic side view with portions removed for purposes of illustration showing an embodiment of the conveying and piling device utilizing compressed air.

When a corrugated board 25 is to be ejected, the conveyor 13 will appear as illustrated in FIG. 5. In this Figure, the endless belts 19 are represented at a standstill, whereas the flexible tapes 32 have been pushed downward by the ejection levers 20, thus compelling the sheet 25 of corrugated board to drop onto the rods 45 and 46 of the jacks 41 and 43. As soon as the action of the ejection levers 20 cause the flexible tapes 32 to be detached from the lower surface 28 of the vacuum chambers 29, the aspiration or suction build-up through the holes 53 will be opened to the atmosphere by side zones 56 situated between the conveyor 13 and the sheet 25 and by the apertures 52 of the ducts 49 being open. Experience has shown that the sole connection to the atmosphere through the side zones 56 was not sufficient to enable the dropping of the sheet 25 of corrugated board and if the plate or sheet 25 was not to be seized by aspiration against a conveyor 13 during the rise of the flexible tapes 32, it was necessary to bring about an additional linkage to the atmosphere, though situated as close as possible to the aspiration holes 53. Thus, the atmosphere will be drawn into each of the vacuum chambers 29, as indicated by the arrows 58, which extend through the apertures 52 of the ducts 49 through the holes 53 of the chambers. As illustrated in FIG. 8, an additional performance for ejecting the sheets 25 by using the ducts 49 allows blowing air to flow to the zone 56. The arrows 57 and 58 represent the way followed by the aspiration flow when the vacuum chambers 29 are opened to the atmosphere.

Figure 6:
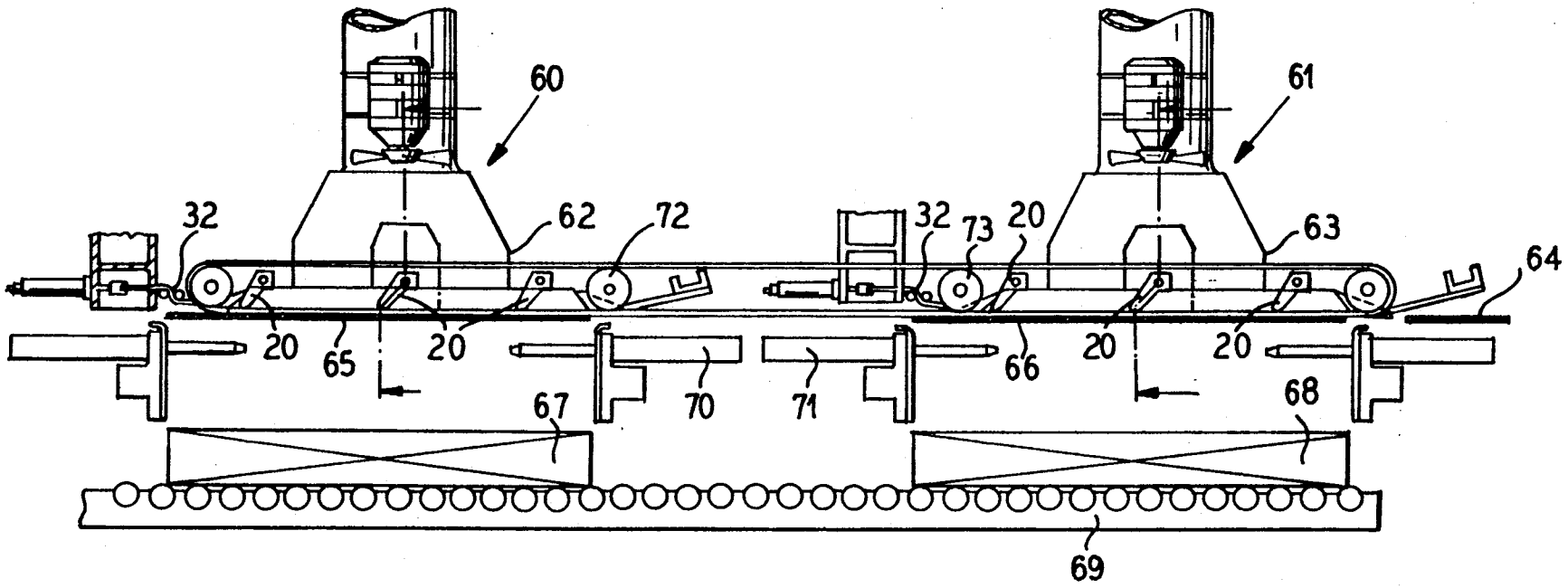
FIG. 6 is a schematic side view with portions removed for purposes of illustration of the conveying and piling device with two stacking stations.

The carrying and piling device illustrated in FIG. 6 includes two pile stores 60 and 61 consisting of two conveyors 62 and 63 identical in their detail to the conveyor 13 previously described. These conveyors 62 and 63, which are arranged one after the other, are placed in such a way that the motion of the ejecting levers 20 can be temporarily declutched or deactivated, thereby allowing the corrugated board 64 to be carried by the conveyors either through the carrier 63 to the carrier 62 to the position illustrated by the board 65, while the following board is carried to the position of the board 66 in the conveyor 63. Thus, the two piling stores 60 and 61 will receive the two boards when the levers 20 are finally actuated to act on their respective flexible tapes 32 so as to make batches 67 and 68, which will then be removed by the roller conveyor 69. Obviously, it is imaginable that more than two consecutive piling stores might be arranged in order to pile a greater number of batches. Another solution would consist in replacing one of these piling stores with an unloading station allowing the gathering of corrugated plates either of an unsuitable shape or damaged in the corse of their run through the processing machine. One of the outstanding characteristics of this solution is that the transition from one piling store to another is achieved in the same conveying plane. For practical reasons, the piling stores 60 and 61 should be arranged as close as possible to one another so as to insure an optimum transportation of the corrugated board plate. To this aim, it would be possible, for instance, to build the jack cylinders 70 and 71 to extend into the area of one another so as to obtain the shortest possible distance between the axis of the pulleys 72 and 73.

Figure 7:
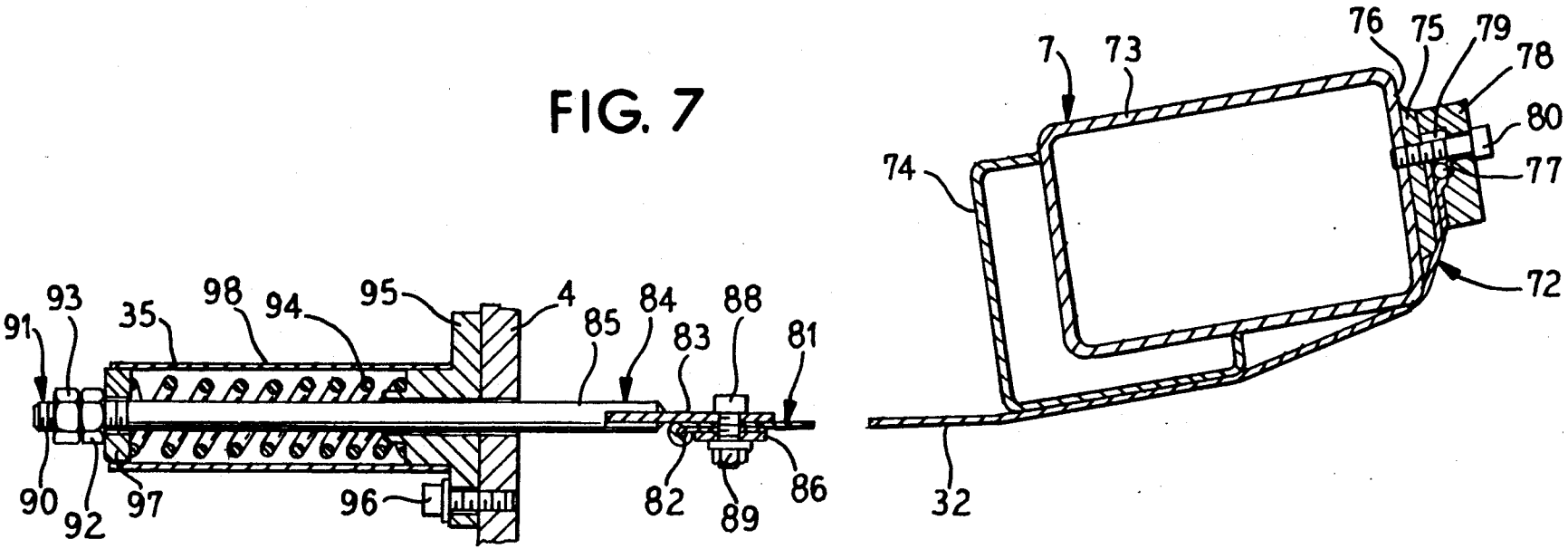
FIG. 7 is an enlarged cross sectional view illustrating the fastening of the flexible tapes used for ejecting the flat workpieces.

A possible way of fastening the flexible tapes 32 is illustrated in FIG. 7. As previously explained, one of the ends, such as 72, of the flexible tape 32 is attached to the cross member 7, which consists of a metal tube 73 of a rectangular cross section. A guiding piece 74, which has been appropriately machined, is set into the metal tube with a square section welded onto the tube 73. Moreover, a reinforcement piece 75 is welded on a surface 76 of the tube 73. The end 72 of the flexible tape 32 is bent around a rod or pin 77 of a circular section. A clamping element or scotch 78 is provided with a housing 79 allowing engagement of the end 72 of the flexible tape 32, which is bent around the rod 77. The end 72 is locked in place by tightening the scotch 78 against the reinforcement piece 75 by means of screws, such as 80. The flexible tape extends over the guiding piece 74 and its other end 81, which is also bent around a rod 82 is squeezed between a plate 73, which is welded onto an end 84 of a pull-rod 85, and a counterplate 86 by means of a screw 88 and nut 89. The pull-rod 85 on the other end 91 has threads 90 on which will be threaded a nut 92 and a counter-nut 93, which limits movement of a washer 97 on the rod 85. A spring 94 is entrapped between the washer 97 and a collar 95, which is mounted on the cross member 4 by means of a screw 96. The coaction of the spring 94 provides means for maintaining the flexible tape 32 taut due to the biasing action of the spring. To complete the means 35, an outer tube 98 is fixed onto the collar 94 and the washer 97 is free to move axially within the tube 98.

As mentioned before, instead of relying solely on atmospheric pressure in the ducts 49, the ducts 49 may have their ends closed and be connected by means of a line 99 to an outlet duct 40 through a pipe 100. Preferably, the line should be equipped with a pressure limiter 101, schematically shown in FIG. 8. It is, of course, understood that the set-up of the overpressure device is put forth as an example only and that it should be possible to also use a separate pressure source for supplying a positive pressure to each of the ducts 49.

Figure 9:
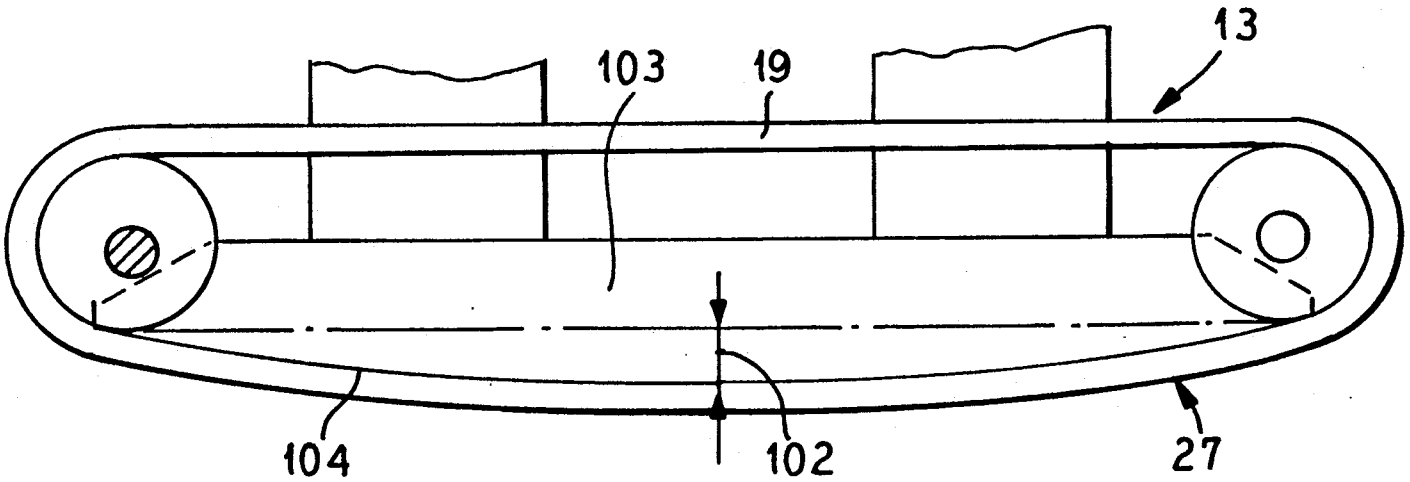
FIG. 9 is a diagrammatic side view of the conveyor belts illustrating a modification in the surface of the vacuum chamber.

As best illustrated in FIG. 9, a lower run 27 of the endless belt 19, even when stretched, always shows an operational deflection 102, which is intentionally exaggerated in FIG. 9. Such an operational deflection 102 can impair the aspiration if the vacuum chamber 29 with a perfectly flat, planar lower surface 28 is used. In order to overcome this drawback, a vacuum chamber 103 is preferably used with a lower surface 104 appropriately machined, as required by the previously measured and calculated deflection 102 of the lower run of the endless belt 19. The lower surface 104 of the vacuum chamber 103 will, thus, have a convex surface of a radius of curvature which corresponds to the radius of curvature of the deflection 102. Thus, each of the endless belts and the flexible tapes will run on this convex surface to prevent the reduction in the aspiration mentioned hereinabove.

Figure 10:
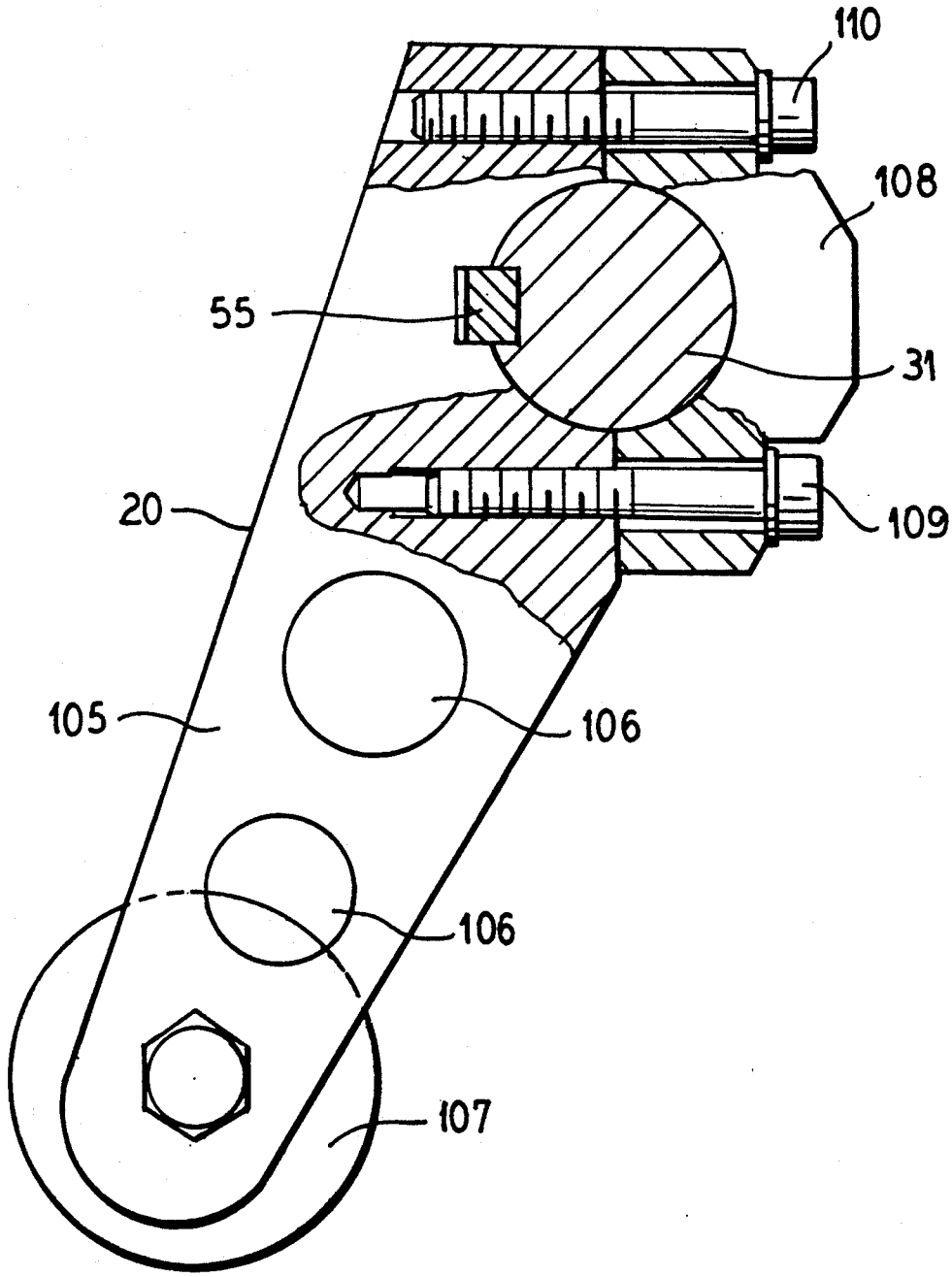
FIG. 10 is a side view with portions removed for purposes of illustration of an ejecting lever in accordance with the present invention.

An example of the structure of each of the ejecting levers 20 is illustrated in FIG. 10. Each lever includes a body 105 with appropriately conceived recesses or openings 106, which are intended to reduce its mass. Pressing means, such as, for example, a roller 107 are fitted on one end of the body 105. The roller 107 could be formed by the outer race of a roller or ball bearing. The other end of the body 105 is equipped with a shell 108 designed for holding the body 105 on the shaft or axle 31 by means of screws 109 and 110. The cotter 55 is to insure that the transmission of the rotation of the shaft 31 to the lever 20 to cause a pivoting of the lever around the axis of the shaft 31.

Although various minor modifications may be suggested by those versed in the art, it should be understood that I wish to embody within the scope of the patent granted hereon all such modifications as reasonably and properly come within the scope of my contribution to the art.

I claim:

1. A device for conveying and piling flat workpieces, said device comprising a frame having endless conveyor belts arranged side-by-side, means for advancing the conveyor belts in a stepwise manner, a separate vacuum chamber for each belt being arranged with a lower surface of the vacuum chamber contacting an upper surface of a lower run of the conveyor belt, said vacuum chambers being separated from one another by a duct and being provided with aspiration holes situated in the vicinity of a side edge of the respective endless belt, said vacuum chambers being interconnected to a common aspiration hood, ejectors being arranged within the duct which separate the vacuum chambers, each ejector comprising a pivoting lever acting on a linear element mounted at one end on the frame of the device at a fixed point and having the other end connected to compensating means to enable expansion and contraction of the linear element, said linear element closing an aperture on a lower part of said duct, which aperture is arranged on substantially the same surface as the lower surface of the vacuum chamber so that when the ejectors are in a retracted position, the linear element closes the duct and when the ejectors are moved to an ejecting position, the linear element opens the duct to enable air in the duct to flow into the vacuum chambers to break a suction on a workpiece formed by the chambers.

2. A device according to claim 1, wherein the lower surface of each of the vacuum chambers has a convex curvature corresponding to the radius of curvature of the deflection of the lower run of the endless belts.

3. A device according to claim 1, wherein the linear element comprises a flexible tape fixed at one end on a first cross member located adjacent an inlet to the endless belts and having the other end being held by the compensating means to a second cross member located downstream of the first-mentioned cross member, said compensating means including a compression spring.

4. A device according to claim 1, wherein the duct separating the vacuum chambers is connected to the atmosphere.

5. A device according to claim 1, wherein the linear element comprises a belt section.

6. A device according to claim 1, wherein means for pivoting each of the ejecting levers is declutchably connected to the means for stepwise driving of the endless belts.

7. A device according to claim 1, wherein the duct separating the vacuum chambers is connected to a compressed air source.

8. A device according to claim 1, wherein each of the ejecting levers is equipped with supporting means on the end acting on the linear element.

9. A device according to claim 8, wherein the supporting means is a roller mounted on an end of the lever.

* * * * *